US008641278B2

(12) United States Patent
Ducauchuis et al.

(10) Patent No.: US 8,641,278 B2
(45) Date of Patent: Feb. 4, 2014

(54) AUTOMATIC GRIPPING DEVICE WITH EXTREMELY FLEXIBLE HOOKS

(75) Inventors: Jean-Pierre Ducauchuis, Nantes (FR); Thierry Marche, La Chapelle Basse Mer (FR)

(73) Assignee: Aplix, Paris (FR)

( * ) Notice: Subject to any disclaimer, the term of this patent is extended or adjusted under 35 U.S.C. 154(b) by 676 days.

(21) Appl. No.: 12/451,922

(22) PCT Filed: May 16, 2008

(86) PCT No.: PCT/FR2008/000681
§ 371 (c)(1),
(2), (4) Date: Dec. 3, 2009

(87) PCT Pub. No.: WO2009/004135
PCT Pub. Date: Jan. 8, 2009

(65) Prior Publication Data

US 2010/0135600 A1 Jun. 3, 2010

(30) Foreign Application Priority Data

Jun. 13, 2007 (FR) ..... 07 04202

(51) Int. Cl.
*B65D 33/16* (2006.01)

(52) U.S. Cl.
USPC ..... 383/61.1; 383/61.2; 383/63; 24/403; 24/410

(58) Field of Classification Search
USPC ..... 383/61.2, 61.3, 63, 64, 61.1; 24/403, 24/409–414
See application file for complete search history.

(56) References Cited

U.S. PATENT DOCUMENTS

| | | | | | |
|---|---|---|---|---|---|
| 2,249,841 | A | * | 7/1941 | Loos et al. | 190/119 |
| 2,271,211 | A | * | 1/1942 | Stockton | 24/384 |
| 3,192,589 | A | * | 7/1965 | Pearson | 24/452 |
| 4,056,593 | A | | 11/1977 | de Navas Albareda | 264/145 |
| 4,290,174 | A | * | 9/1981 | Kalleberg | 24/444 |
| 4,322,875 | A | * | 4/1982 | Brown et al. | 24/447 |
| 4,454,183 | A | * | 6/1984 | Wollman | 428/92 |
| 4,665,557 | A | * | 5/1987 | Kamp | 383/63 |
| 4,691,370 | A | * | 9/1987 | MacFee | 383/61.3 |
| 4,787,880 | A | * | 11/1988 | Ausnit | 493/213 |
| 5,040,275 | A | * | 8/1991 | Eckhardt et al. | 24/447 |
| 5,056,933 | A | * | 10/1991 | Kamp | 383/63 |

(Continued)

FOREIGN PATENT DOCUMENTS

| | | | | |
|---|---|---|---|---|
| EP | 0 421 295 A1 | 9/1990 | ..... | A44B 18/00 |
| WO | WO 99/22626 | 5/1999 | ..... | A47G 27/04 |
| WO | WO 2004/112527 A1 | 12/2004 | | |

*Primary Examiner* — Jes F Pascua
*Assistant Examiner* — Peter Helvey
(74) *Attorney, Agent, or Firm* — Renner, Kenner, Greive, Bobak, Taylor & Weber

(57) ABSTRACT

An automatic gripping closure device comprising a first element with hooks comprising a first base band and at least two first hooks originating from the first band and placed in at least one row of first hooks (9), each first hook being delimited by two faces (11, 12) that are mutually opposed and transverse to the direction of the at least one row of first hooks and at least one coupling portion (13, 14) protruding laterally from the stem, preferably at the top of the latter, while extending in a direction transverse to the direction of the row, and a second element with hooks comprising a second base band and at least two second hooks originating from the second band and placed in at least one row.

21 Claims, 2 Drawing Sheets

(56) References Cited

U.S. PATENT DOCUMENTS

| | | | | | |
|---|---|---|---|---|---|
| 5,067,210 | A | * | 11/1991 | Keyaki | 24/452 |
| 5,070,584 | A | * | 12/1991 | Dais et al. | 24/585.12 |
| 5,077,870 | A | * | 1/1992 | Melbye et al. | 24/452 |
| 5,138,750 | A | * | 8/1992 | Gundlach et al. | 24/585.12 |
| 5,140,727 | A | * | 8/1992 | Dais et al. | 24/585.12 |
| 5,273,511 | A | * | 12/1993 | Boeckman | 493/195 |
| D367,419 | S | * | 2/1996 | Murasaki | D8/382 |
| 5,755,015 | A | * | 5/1998 | Akeno et al. | 24/452 |
| 5,878,468 | A | * | 3/1999 | Tomic et al. | 24/585.12 |
| 5,902,427 | A | * | 5/1999 | Zinke et al. | 156/73.1 |
| 5,974,635 | A | * | 11/1999 | Murasaki | 24/446 |
| 6,209,177 | B1 | * | 4/2001 | Murasaki | 24/452 |
| 6,484,371 | B1 | * | 11/2002 | Romanko et al. | 24/306 |
| 6,789,946 | B2 | * | 9/2004 | Plourde et al. | 383/63 |
| 7,044,834 | B2 | * | 5/2006 | Chesley et al. | 451/28 |
| 7,340,807 | B2 | * | 3/2008 | Dais et al. | 24/443 |
| 7,520,033 | B2 | * | 4/2009 | Clarner | 24/452 |
| 7,946,766 | B2 | * | 5/2011 | Dais et al. | 383/59 |
| 2003/0031386 | A1 | | 2/2003 | Shepard et al. | 383/61.1 |
| 2003/0131453 | A1 | | 7/2003 | Clarner et al. | 24/452 |
| 2005/0081346 | A1 | * | 4/2005 | Clarner | 24/452 |
| 2005/0217087 | A1 | | 10/2005 | Gallant | 24/452 |
| 2006/0168776 | A1 | | 8/2006 | Dais et al. | 24/401 |

* cited by examiner

AUTOMATIC GRIPPING DEVICE WITH EXTREMELY FLEXIBLE HOOKS

TECHNICAL FIELD

The present invention relates to a bag, in particular a bag composed of flexible material, having an opening and comprising an automatically gripping closure device referred to as having hooks in hooks, comprising a first element which is constituted by a first base strip and first hooks which protrude from this first base strip and a second element which is constituted by a second base strip and second hooks which protrude from the second base strip, the first and second hooks mutually engaging in order to close the opening.

BACKGROUND ART

There are already known, from the prior art, automatically gripping closures referred to as having hooks in hooks. In particular when they are used to close a bag of plastics material, these closures have a number of disadvantages. On the one hand, they lack much flexibility, the edges of the opening facing each other and carrying the respective hooked strips having, when the devices of the prior art are used, a large degree of rigidity, which is disadvantageous to the use of the plastics bag. Furthermore, these closures having hooks in hooks of the prior art have the additional disadvantage, in the case of plastics bags which are intended to contain small products, in particular in powdered, liquid or granulated form, that small particles, such as grains or dust, have a tendency to become trapped under the hooks of the hooked strips. Consequently, these small particles which are jammed below the hooks may impair the correct operation of the closure. If retained for a long time below the hooks, they can further bring about contamination of the product contained in the bag when it is reused for a product of another type.

Furthermore, in the prior art, the only existing plastics bags which comprise such hook-in-hook closures comprise hooked strips which have been produced by means of a moulding method which is complicated to implement, in particular owing to difficulties during removal from the mould.

DISCLOSURE OF THE INVENTION

An object of the present invention is to overcome these disadvantages, and others, of the prior art by providing a bag of flexible material, in particular of plastics material, which comprises an automatically gripping closure, referred to as having hooks in hooks, of the type mentioned above, which allows a closure to be produced along two facing portions at the edge of an opening, whilst retaining a large degree of flexibility during use, in particular in the case of a plastics bag, and which, at the same time, operates better than the devices of the prior art, and in particular with small products being less capable of impairing the closure and/or contaminating the contents of the bag.

There is thus obtained a bag of flexible material which comprises an automatically gripping closure of the hook-in-hook type which is very simple to produce (using the method of extrusion) but which operates well, and which in particular retains in the region of the opening thereof a large degree of flexibility and good sealing.

Preferably, the second hooks having a second thickness corresponding to the distance in the direction of the at least one row of second hooks between the two facing surfaces, and the second spacing distance between the at least two second hooks is greater than at least the thickness of each second hook, preferably at least 1.5 times the thickness, even more preferably at least double the thickness, of the at least two second hooks.

There is thus obtained a hook-in-hook device which has a large degree of flexibility since it is no longer, as in accordance with the prior art, provided with hooks which have a very large thickness. Furthermore, particles, in the form of powder or liquid, for example, have a lesser tendency to become trapped below the projections of the hooks, as was the case in the prior art, but instead do so in the free space between hooks which, according to the present invention, is greater than in the devices of the prior art. It has been found that, in spite of this small thickness, the closure operates advantageously, even though it might have been considered that, by providing such large spacings between two adjacent hooks in a row, there would be, owing to relative sliding, poor fixing linked to untimely occurrences of disengagement.

According to a preferred embodiment of the invention, the first and second thicknesses are identical.

According to a preferred embodiment of the invention, the first spacing distance and the second spacing distance are identical.

According to a preferred embodiment of the invention, the first thicknesses are the same for all the hooks of the first element and/or the second thicknesses are the same for all the hooks of the second element.

According to a preferred embodiment, the first hooked element comprises from 3 to 13 rows of hooks, which are preferably mutually parallel, in particular 5 or 6 rows.

According to a preferred embodiment of the invention, the second element comprises from 3 to 13 rows, which are preferably mutually parallel, in particular 5 or 6 rows.

According to a preferred embodiment of the invention, the spacing between two successive hooks of a row is identical over the entire first hooked element and/or over the entire second hooked element.

According to a preferred embodiment of the invention, the rows of hooks of the first element are offset relative to each other, and/or the rows of hooks of the second element are offset relative to each other.

According to an advantageous embodiment, the first and second strips are constituted by a common strip which is folded over on itself in order to form the two elements at one side and the other of the fold.

According to a preferred embodiment of the invention, the hooks are produced by a device referred to as REPLA which involves extruding a plastics material from a die in order to form a strip which has mutually parallel oblong ribs which are hook-like in cross-section, cutting these ribs transversely from the strip, then drawing the strip in the longitudinal direction of the ribs in order to separate the cut portions from each other and to obtain the rows of hooks.

Preferably, the first strip and/or the second strip comprise(s) longitudinal portions which form selvedges without any hooks, between which a central portion from which the hooks are produced is located. These selvedges in particular make it easier to weld the strip(s) in the region of an edge of a plastics bag, for which it is desirable to produce a closure using the devices according to the invention.

According to one embodiment, the bag is constituted by two sheets which are fixed to each other along their perimeter, with the exception of at least a portion of the upper edge thereof, in order thereby to define an opening, each portion of the upper edge comprising one of the hooked elements facing the other hooked element on the other portion of the upper edge, the hooks of the two elements being orientated in opposite directions.

According to another possible embodiment, the plastics bag is constituted by two sheets which are fixed to each other along the perimeter thereof, with the exception of at least a portion of the upper edge thereof, in order thereby to define an opening, and the two hooked elements are each fixed to a sheet, and offset relative to each other in the height direction, with their hooks being orientated in the same direction, the closure being carried out by folding the sheet having the highest element over the sheet having the lowest element.

There will now be described, by way of example, an embodiment of an automatically gripping device according to the invention, which is in particular used in the case of a bag of plastics material.

PREFERRED EMBODIMENTS FOR CARRYING OUT THE INVENTION

Figure 1:
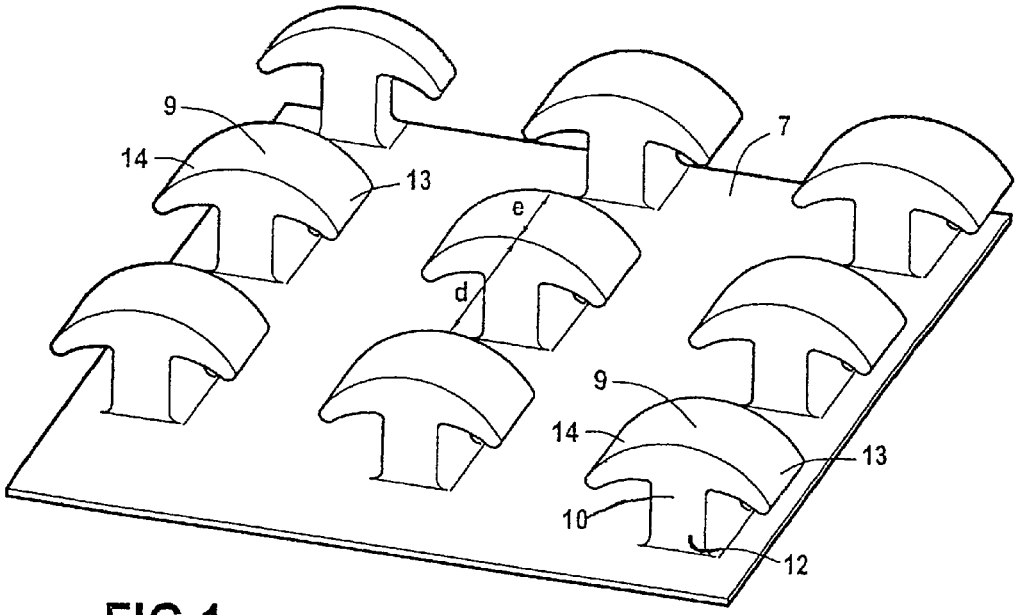
FIG. 1 is a perspective plan view of a portion of an automatically gripping element having hooks, which is intended to be engaged with another identical element in order to form a closure.
Figure 2:
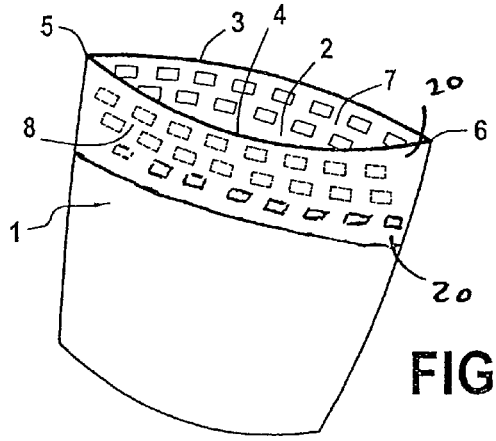
FIG. 2 is a perspective view of a plastics bag having an opening comprising the automatically gripping device of FIG. 1.
Figure 3:
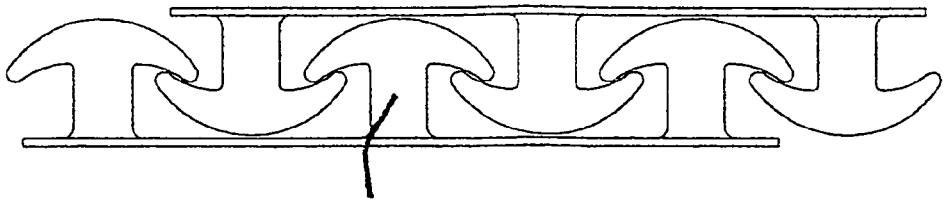
FIG. 3 is a sectioned view which shows the interaction between the hooks of the two strips in order to produce the closure.

In FIG. 2, a plastics bag 1 comprises an opening 2 which is delimited by a first edge 3 and a second edge 4 which join at an end location 5 and a second end location 6. Each of the edges 3 and 4 comprises, fixed in particular by means of adhesive-bonding or any other means (thermal or ultrasound welding, etc.), a hooked strip 7, as illustrated in FIG. 1, and an identical hooked strip 8, respectively. Each strip is constituted by a central hooked portion which is delimited at one side and the other by two longitudinal selvedge portions 20.

The hooked strip 7 is of conventional thermoplastic material, such as polyethylene, polypropylene, etc. It comprises a plurality of hooks 9 which are each delimited by two lateral surfaces 11 and 12 and which each comprise a shank 10 of substantially rectangular parallelepipedal form. The hooks are arranged in rows which are mutually parallel. The lateral surfaces 11 and 12 extend in this instance perpendicularly relative to the extension direction of the rows. They could also be inclined, for example, through an angle of from 10° to 30°, in relation to the perpendicular relative to the direction of the rows.

The two lateral surfaces 11 and 12 are planar, in accordance with the fact that they have been formed by means of cutting with a knife as in accordance with the method which is referred to below as the De Navas or Repla method and which is described in the U.S. Pat. No. 4,056,593. The head and the shank of each hook are both delimited at one side and the other by these two planar lateral surfaces.

Two left and right extension portions which form hook projections 13 and 14 protrude laterally at one side and the other in the direction perpendicular relative to the direction of the rows of the upper portion of the shank 10. These projections 13 and 14 form the engagement portion of the hook. The thickness of the hook 9 is the distance in the extension direction of the rows between the two surfaces 11 and 12. In the same row, the hooks are arranged spaced apart from each other. This distance between hooks, measured by the distance in the region of the base (or the upper surface of the strip) of the shank between the mutually facing planar lateral surfaces of a hook and an adjacent hook in the same row, respectively, and measured in the direction of the row, is designated d in FIG. 1. This distance d is greater than or equal to the thickness e of the hooks, on the first strip 7 which is located at the edge 3 and on the second strip 8 which is located at the edge 4.

The thickness of the hooks may be between 0.1 and 1 mm, and is in particular 0.3 mm.

The height of the hooks, that is to say, the vertical distance of the shank 10 from the base up to its top, may be between 0.3 and 1.5 mm.

The width of the hook, that is to say, extending from a leading edge of a projection to the leading edge of the other projection, may be between 0.3 and 1.3 mm.

There are provided hooks at a density, for example, of between 50 and 100 hooks per $cm^2$, in particular 59.

The selvedges may have a width (direction CD) of between 3 and 12 mm, in particular from 7 to 9 mm, whilst the central portion has a width of from 3 to 12 mm, in particular 6 mm.

The base strip has a thickness of, for example, between 0.1 mm and 0.5 mm, in particular 0.16 mm.

Preferably, the rows are spaced-apart from each other by a distance such that, when a hook is inserted with its head orientated in the other direction relative to the hook, the projections thereof become engaged with a projection of a hook from one row and a projection of a hook from another row adjacent to that row, respectively.

Preferably, the hooks from one row are offset, in the extension direction of the rows, relative to the hooks of the adjacent row by a distance 1. 1 is generally less than the thickness of the hooks but is greater than or equal to the ratio of the distance between hooks over the number of rows (d/n). In particular, as in the Figure, 1 may correspond to substantially one third of the thickness for three rows.

Figure 4:
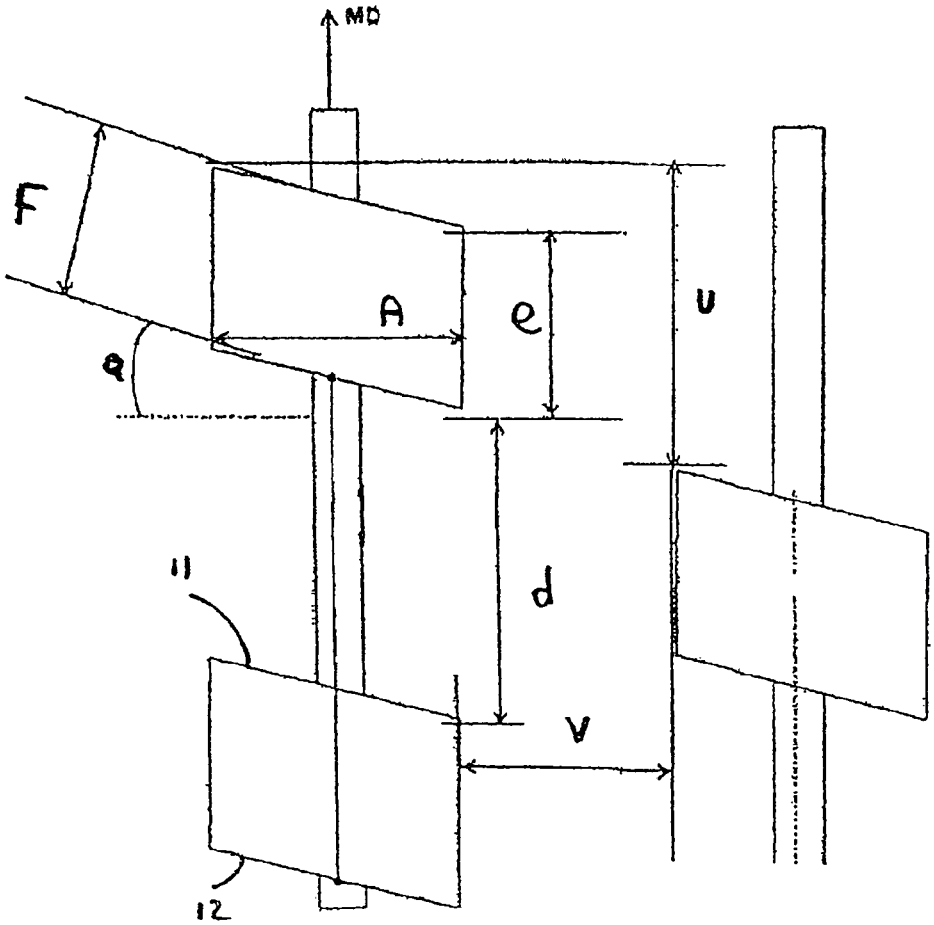
FIG. 4 is a view equivalent to FIG. 1*a* when the hooks are constructed with a head which forms an angle which is different from 90° with the machine direction.

In the case illustrated in FIG. 4, the head of the hook is of lozenge-like form when viewed from above. The angle formed between each lateral surface 11 and 12 and the machine direction is 90°-Q, where Q is an angle which is generally between 10 and 30°.

F designates the thickness of the hook measured in the direction perpendicular relative to the lateral surfaces 11 and 12. When Q=0 (as in FIGS. 1 and 1*a*), F is equal to e.

Figure 1A:
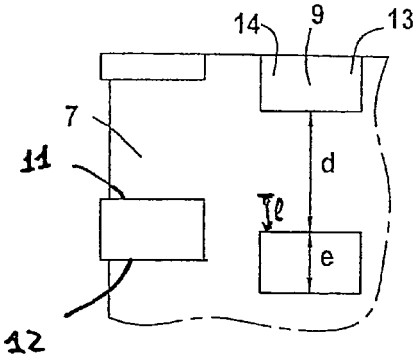
FIG. 1*a* is a plan view of a portion of the element of FIG. 1.

U designates the distance measured in the machine direction between two similar locations of two hooks which are immediately adjacent to each other and located on two adjacent rows. In the case of FIGS. 1 and 1*a*, U is equal to 1+e.

So that the two strips mutually grip in the most optimal manner possible, and in particular without their becoming detached from one another in an untimely manner in the event of a simple relative sliding action, it is preferable for the following relationships to be complied with:

$$\frac{1}{2}\left[\frac{d}{2(N-1)}+\frac{d-F}{3(N-1)}\right]\leq U\leq\frac{1}{2}\left[d-\left(\frac{d}{2(N-1)}\right)-\left(\frac{d-F}{3(N-1)}\right)\right]$$

and $$\frac{d}{2} \geq F \geq \frac{d}{(N-1)}$$

Furthermore, it is also preferable for the width A of the hook head to be greater than 1.4 times the distance V measured in the transverse direction (or CD) between two hooks of two immediately adjacent rows.

The production of these hooked strips may be carried out using a conventional system or process referred to as REPLA or De Navas (see U.S. Pat. No. 4,056,593). Ribs are produced by means of extrusion having, in cross-section, the shape of the final double hook which it is desirable to obtain. These extruded ribs are then cut in a transverse direction, in particular a perpendicular direction, relative to the extension direction of the ribs (which direction substantially corresponds to the direction of the rows) with the knife cuts being offset by a dimension which corresponds to the thickness which it is desirable to obtain for each hook at the end. After the cut has been made, the sheet is drawn in order to draw the base strip and separate the hooks from each other, as previously formed by the cut. The final product illustrated in FIG. 2 is thus obtained. It will be understood that the thickness of the hooks on a given strip is not necessarily constant. The thickness of the hooks of the first hooked element is not necessarily equal to the thickness of the hooks of the second hooked element. In the same manner, the distances between hooks are not necessarily constant over the entire row, nor over the entire strip.

The invention claimed is:

1. A bag of flexible material, comprising an opening, the bag comprising a device for closing the opening of the automatically gripping hook-in-hook type, comprising a first element having hooks and a second element having hooks, the hooks of the two elements engaging with each other in order to bring about the closure of the opening, the first element having hooks comprising a base strip and at least two parallel rows of hooks produced from the strip, and the second element having hooks comprising a base strip and at least one row of hooks produced from the strip, wherein:

each hook of the first element is delimited over the entire height thereof, from the base strip as far as the top thereof, by two mutually opposed planar surfaces which are transverse relative to the direction of the two rows of hooks;

each hook of the first element comprises two right and left projection-like engagement portions which project laterally from a shank extending in a transverse direction relative to the direction of the rows and in opposite right and left directions;

each hook of the first element has a thickness corresponding to the distance in the direction of the two rows of hooks between the two mutually opposed, planar surfaces in the region of the base strip;

the spacing distance between two successive hooks of each of the at least two rows of the first element, measured in the region of the base strip in the direction of the two rows, or longitudinal direction, is greater than the thickness of each hook;

the at least two rows of the first element are spaced apart from each other by a distance such that when hooks of the at least one row of the second element are inserted therebetween with their heads orientated in a direction opposite to the heads of the hooks of the first element, an engagement portion of at least a first hook of the second element is adapted to become engaged with an engagement portion of a hook from one row of the first element and another engagement portion of said at least first hook or an engagement portion of a second hook of said at least one row of the second element is adapted to become engaged with an engagement portion of a hook from another row of the first element adjacent to said one row.

2. The bag of claim 1, wherein:

each hook of the second element is delimited over the entire height thereof, from the base strip as far as the top thereof, by two mutually opposed planar surfaces which are transverse relative to the direction of the at least one row of hooks and which are formed by cutting;

each hook of the second element comprises two right and left projection-like engagement portions which project laterally from a shank, extending in a transverse direction relative to the direction of the row and in opposite right and left directions;

each hook of the second element has a thickness corresponding to the distance in the direction of the at least one row of hooks between the two mutually opposed, planar surfaces in the region of the base strip; and the spacing distance between two successive hooks of the at least one row of the second element, measured in the region of the base strip in the direction of the at least one row, or longitudinal direction, is greater than the thickness of each hook.

3. The bag of claim 1 wherein the first element and/or the second element are produced by extrusion of a strip comprising longitudinal ribs which are parallel with each other and which have a cross-section having the same shape as the cross-section of the hooks, then by cutting transversely relative to the longitudinal extent of the ribs and drawing in the longitudinal direction, in such a manner that the opposed planar surfaces correspond to the transverse cutting.

4. The bag of claim 1, wherein the spacing distance is at least 1.5 times greater than, even more preferably at least two times greater than, the thickness of each hook.

5. The bag of claim 1, wherein the two mutually opposed, planar surfaces are parallel.

6. The bag of claim 1, wherein the at least two parallel rows are offset relative to each other by an offset distance measured in the direction of the rows or the longitudinal direction.

7. The bag of claim 6, wherein the offset distance is less than the thickness.

8. The bag of claim 1 wherein the lateral planar surfaces define, when viewed in section in the plane of the base strip, an angle, which is not zero relative to the direction perpendicular to the longitudinal direction.

9. The bag of claim 8, wherein the angle is between 1 and 10°.

10. The bag of claim 2, wherein the base strip of the first element and/or the base strip of the second element comprise longitudinal portions which form selvedges without any hooks, between which a central portion from which the hooks are produced is located.

11. The bag of claim 2, wherein the strip of the first element and the strip of the second element are constituted by a common strip which is folded over on itself in order to form the two elements at one side and the other of the fold.

12. The bag of claim 1 wherein it is constituted by two sheets which are fixed to each other along their perimeter, with the exception of at least a portion of the upper edge thereof, in order thereby to define an opening, each portion of the upper edge comprising one of the hooked elements facing the other hooked element on the other portion of the upper edge, the hooks of the two elements being orientated in opposite directions.

13. The bag of claim 1 wherein it is constituted by two sheets which are fixed to each other along the perimeter thereof, with the exception of at least a portion of the upper edge thereof, in order thereby to define an opening, and the two hooked elements are each fixed to a sheet, being offset relative to each other in the height direction, with their hooks being orientated in the same direction, the closure being carried out by folding the sheet having the highest element over the sheet having the lowest element.

14. The bag of claim 2, wherein the thickness of each hook of the first element and the thickness of each hook of the second element are identical.

15. The bag of claim 2, wherein the spacing distance between two successive hooks of each row of the first element and the spacing distance between two successive hooks of each row of the second element are identical.

16. The bag of claim 1, wherein all the hooks of the first element have the same thickness.

17. The bag of claim 2, wherein all the hooks of the second element have the same thickness.

18. The bag of claim 1, wherein the spacing distance between two successive hooks of a row is identical over the entire first hooked element and/or over the entire second hooked element.

19. The bag of claim 1, wherein the mutually opposed planar surfaces and a direction perpendicular to the longitudinal direction form, when viewed in section in the plane of the base strip, an angle comprised between 10° and 30°.

20. The bag of claim 1, wherein the rows of the first element are spaced apart from each other by a distance such that when a hook of the second element is inserted with its head orientated in the other direction relative to a hook of the first element, the engagement portions thereof are configured to become engaged with an engagement portion of a hook from one row of the first element and an engagement portion of a hook from another row of the first element, adjacent to that row, respectively.

21. The bag of claim 6, wherein the offset distance is greater than or equal to the ratio f the spacing distance between two successive hooks of one row over the number of rows.

* * * * *